United States Patent [19]

Wagstaff et al.

[11] Patent Number: 4,598,763

[45] Date of Patent: Jul. 8, 1986

[54] DIRECT CHILL METAL CASTING APPARATUS AND TECHNIQUE

[75] Inventors: Frank E. Wagstaff; William G. Wagstaff; Richard J. Collins, all of Spokane, Wash.

[73] Assignee: Wagstaff Engineering, Inc., Spokane, Wash.

[21] Appl. No.: 708,387

[22] Filed: Mar. 8, 1985

Related U.S. Application Data

[63] Continuation of Ser. No. 435,476, Oct. 20, 1982, abandoned.

[51] Int. Cl.[4] ..... B22D 11/07; B22D 11/124

[52] U.S. Cl. ..... 164/472; 164/268; 164/444; 164/487

[58] Field of Search ..... 164/268, 418, 443, 444, 164/459, 472, 486, 487

[56] References Cited

U.S. PATENT DOCUMENTS

| | | | |
|---|---|---|---|
| 3,329,200 | 7/1967 | Craig | 164/440 |
| 3,342,252 | 9/1967 | Wood et al. | 164/472 |
| 3,702,155 | 11/1972 | Getselev | 164/503 |
| 3,773,101 | 11/1973 | Getselev | 164/503 |
| 3,847,206 | 11/1974 | Foye | 164/425 |
| 4,004,631 | 1/1977 | Goodrich et al. | 164/503 |
| 4,057,100 | 11/1977 | Lossack | 164/418 |
| 4,157,728 | 6/1979 | Mitamura et al. | 164/472 |
| 4,369,832 | 1/1983 | Pryor et al. | 164/472 |

FOREIGN PATENT DOCUMENTS

| | | |
|---|---|---|
| 0035958 | 4/1981 | European Pat. Off. . |
| 50-27807 | 9/1975 | Japan . |
| 233288 | 10/1944 | Switzerland . |
| 686413 | 1/1953 | United Kingdom . |
| 968866 | 9/1964 | United Kingdom . |
| 1144208 | 3/1969 | United Kingdom . |
| 2014487A | 2/1979 | United Kingdom . |
| 508332 | 5/1976 | U.S.S.R. . |

*Primary Examiner*—Nicholas P. Godici
*Assistant Examiner*—Richard K. Seidel
*Attorney, Agent, or Firm*—Christopher Duffy

[57] ABSTRACT

One end opening of an open ended mold cavity has a diameter smaller than the peripheral wall of the cavity and a molten metal mass is introduced to the cavity by continuously filling the one end opening with the mass so that the molten metal splays about the inner peripheral edge of the opening to assume a cross-section between the ends of the cavity having a divergent/convergent outline, the intermediate continuum of which between the planes of maximum divergence and minimum convergence thereof, has a peripheral outline corresponding generally to the outline of the cavity at the peripheral wall thereof. A graphite or graphite-like ring is circumposed about the axis of the cavity in the peripheral wall thereof to form a solid but fluid permeable wall section that is disposed to define the peripheral outline of the intermediate continuum of the metallic mass. A lubricating oil and a gas are delivered to grooves on the outer peripheral portion of the ring, and are caused to diffuse simultaneously through the body of the ring so as to discharge into the cavity at the inner peripheral surface of the ring while the molten metal mass is chilled and the mold and a support are reciprocated in relation to one another axially of the cavity to form the chilled mass into an elongated body of the metal.

25 Claims, 16 Drawing Figures

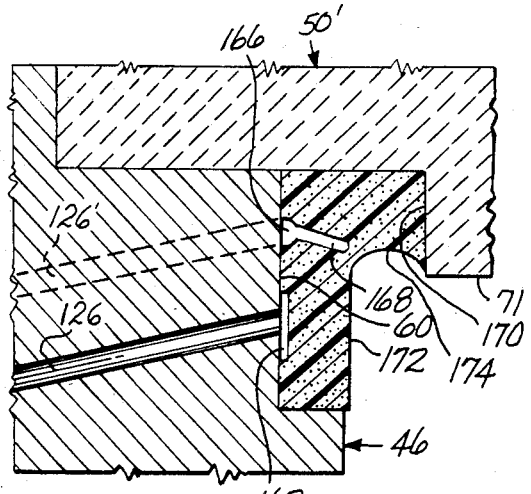
Fig. 10
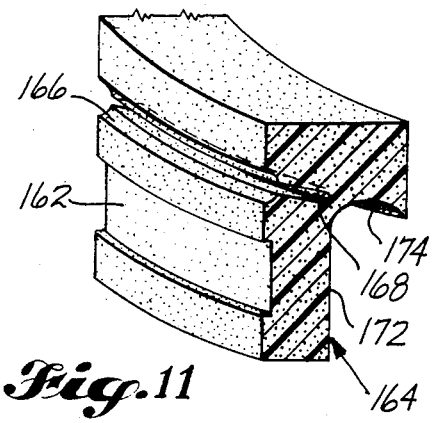
Fig. 11
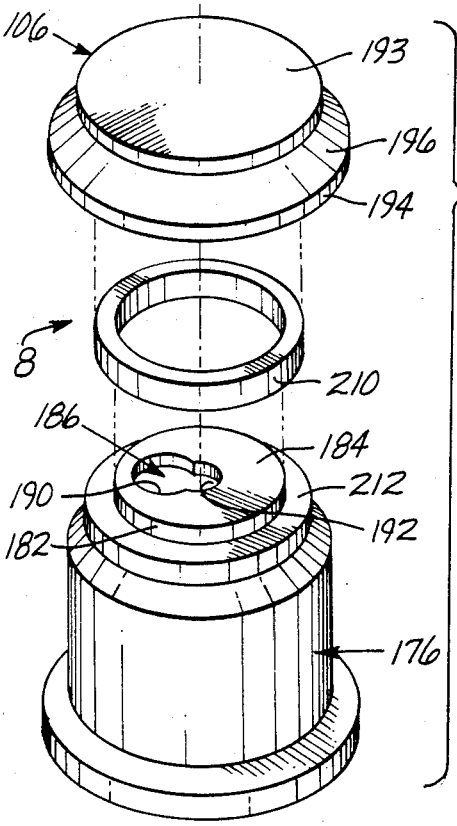
Fig. 12
Fig. 13
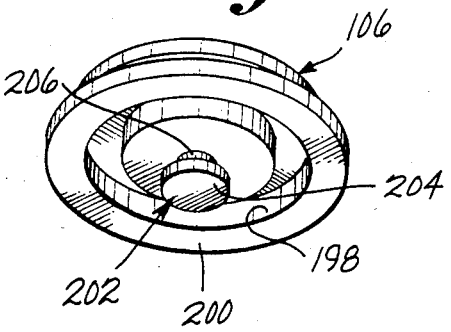

DIRECT CHILL METAL CASTING APPARATUS AND TECHNIQUE

This application is a continuation of Ser. No. 435,476, filed Oct. 20, 1982, titled DIRECT CHILL METAL CASTING APPARATUS AND TECHNIQUE, now abandoned.

THE INVENTION IN GENERAL

This invention relates to the direct chill casting of metals such as aluminum.

When casting a metal in this fashion, a mass of the molten metal is introduced into an open ended mold cavity having a support telescoped in the discharge end thereof, and the body of molten metal in the cavity is chilled while the mold and support are reciprocated in relation to one another endwise of the cavity to elongate the body of metal. The mass is introduced to the cavity through the opening at the other end of the same, and this other end opening has a diameter smaller than the peripheral wall of the cavity so that the inner peripheral edge of it forms an overhang relatively over the wall. Moreover, the mass is introduced to the cavity by continuously filling the other end opening of the same with molten metal so that the mass of molten metal splays about the inner peripheral edge of the other end opening and forms a metallic mass, the meniscus of which tends to contact the peripheral wall of the cavity in the plane of maximum divergence of the metal. As a consequence, the body of molten metal normally assumes a cross-section which has a divergent/convergent outline between the ends thereof, the intermediate continuum of which between the planes of maximum divergence and minimum convergence thereof, has a peripheral outline corresponding generally to the outline of the cavity at the peripheral wall thereof. Meanwhile, there is a pocket of relatively metal-free space formed between the meniscus of the metal and the overhang of the cavity at the inner peripheral edge of the aforesaid other end opening thereof.

In U.S. Pat. No. 4,157,728, a stream of pressurized air is introduced to the pocket through an annular slit about the overhang, and the pocket is pressurized to depress the meniscus still lower on the peripheral wall of the cavity, that is, to depress the level of the plane of maximum divergence at which the meniscus makes contact with the wall. Additionally, an oil is channeled into the pocket through the slit, or directly into the pocket at a level slightly below the slit, to lubricate the wall.

According to the invention, graphite or graphite-like wall defining means are circumposed about the molten metal body in the peripheral wall of the cavity at a level below the overhang adapted so that the intermediate continuum is surrounded by a solid but fluid permeable wall section of said means. A lubricating oil and an additional fluid medium selected from the group consisting of a highly heat vaporizable liquid medium and a gaseous medium, are simultaneously forced through the fluid permeable wall section so that the oil and additional fluid medium discharge into the cavity at points on the inner peripheral surface of the wall section opposite the intermediate continuum. Simultaneously, the molten metal body is chilled from points below the intermediate continuum and the mold and support are reciprocated in relation to one another endwise of the cavity to elongate the body. Meanwhile, the wall of the cavity co-terminates with the overhang at the aforesaid other end of the cavity so that the part of the molten metal body directly adjacent the overhang is surrounded by a closed corner of the cavity. As a result, the fluid discharged about the intermediate continuum forms an annulus of fluid tending to flow relatively away from the closed corner of the cavity toward the discharge end thereof.

In many of the presently preferred embodiments of the invention, a stream of fluid is impinged on the molten metal body at a level below the plane of minimum convergence, to chill the body, and that part of the body disposed between the level of impingement and the aforesaid fluid permeable wall section, is surrounded by a section of the wall which is impermeable to the fluid.

Additionally, in many of the presently preferred embodiments of the invention, the oil and additional fluid medium are forced into the fluid permeable wall section through the outer peripheral portion thereof. In certain embodiments, for example, the additional fluid medium is a gas, and the oil and gas are forced into the fluid permeable wall section at levels spaced apart from one another endwise of the cavity. In some embodiments, moreover, the oil and gas are forced into the fluid permeable wall section through a pair of spaced circumferential grooves extending about the wall section at the outer periphery thereof. In certain of these, the grooves have sets of holes extending peripherally inwardly therefrom, but terminating in the wall section short of the inner peripheral surface thereof.

The graphite or graphite-like wall defining means may be circumposed about the molten metal body at a level adapted so that the part of the body directly adjacent the overhang is also surrounded by the fluid permeable wall section, and the oil and gas may be forced into the wall section at levels adjacent the overhang and the plane of minimum convergence, respectively.

Furthermore, the fluid permeable wall section may extend beyond the overhang in the endwise direction of the cavity, and may have a step therein which is directed peripherally inwardly of the wall to define a portion of the overhang, the oil being forced into the wall section at a level adjacent the step.

In some embodiments of the invention, the corner is curved opposite the meniscus to control the size of the discharge pocketed therebetween.

Preferably, the mold cavity is disposed so that the end openings thereof are centered on a vertical line.

The invention also concerns a related apparatus for direct chill casting a metal. The apparatus comprises means defining an open ended mold cavity having a discharge end adapted to have a support telescoped therein, and having an opening at the opposing end thereof whose diameter is smaller than the peripheral wall of the cavity so that the inner peripheral edge of the opposing end opening forms an overhang relatively over the peripheral wall. Consequently, when the opposing end opening of the cavity is continuously filled with molten metal, the mass of molten metal splays about the inner peripheral edge of the opposing end opening and forms a body of molten metal in the cavity whose cross-section has a divergent/convergent outline between the ends thereof, the intermediate continuum of which between the planes of maximum divergence and minimum convergence thereof, has a peripheral outline corresponding generally to the outline of the cavity at the peripheral wall thereof. Means are provided for chilling the molten metal body from points below the intermediate continuum, and graphite or graphite-like wall defining means are disposed in the peripheral wall of the cavity at a level below the overhang for surrounding the intermediate continuum of the molten metal body by a solid but fluid permeable wall section. Fluid delivery means are also provided for simultaneously forcing a lubricating oil and an additional fluid medium selected from the group consisting of a highly heat vaporizable liquid medium and a gaseous medium, through the fluid permeable wall section so that the oil and additional fluid medium discharge into the cavity at points on the inner peripheral surface of the wall section opposite the intermediate continuum, while the molten metal body is chilled and the mold and support are reciprocated in relation to one another endwise of the cavity to elongate the body. As indicated earlier, the wall of the cavity co-terminates with the overhang at the aforesaid opposing end of the cavity so that the part of the molten metal body directly adjacent the overhang is surrounded by a closed corner of the cavity. As a result, the fluid discharged about the intermediate continuum forms an annulus of fluid tending to flow relatively away from the closed corner of the cavity toward the discharge end thereof.

Furthermore, as was also indicated earlier, in many of the presently preferred embodiments of the invention, the fluid delivery means are operable to force the oil and additional fluid medium into the fluid permeable wall section through the outer peripheral portion thereof. In some embodiments, the fluid delivery means are operable to force oil and gas into the fluid permeable wall section at levels spaced apart from one another endwise of the cavity. In certain embodiments, there is a pair of spaced circumferential grooves extending about the wall section at the outer periphery thereof, and the fluid delivery means are operable to force the oil and gas into the wall section through the grooves. In some, the grooves have sets of holes extending peripherally inwardly therefrom, but terminating in the wall section short of the inner peripheral surface thereof.

Once again, the graphite or graphite-like wall defining means may be disposed in the wall of the cavity at a level adapted so that the part of the molten metal body directly adjacent the overhang is also surrounded by the fluid permeable wall section, and the fluid delivery means in such a case may be operable to force the oil and gas into the wall section at levels adjacent the overhang and the plane of minimum convergence, respectively.

Also, the fluid permeable wall section may extend beyond the overhang in the endwise direction of the cavity, and may have a step therein which is directed peripherally inwardly of the wall to define a portion of the overhang; and the fluid delivery means may be operable to force the oil into the wall section at a level adjacent the step.

And once again, the corner may be curved opposite the meniscus to control the size of the discharge pocketed therebetween; and the mold cavity may be disposed so that the end openings thereof are centered on a vertical line.

In certain of the presently preferred embodiments of the invention, the overhang is defined by an insulative refractory member, and the member and wall section are disposed so that they abut one another at the overhang. In some of these, the aforesaid opposing end opening of the cavity is defined by an insulative refractory scupper for a hot top, and the scupper is centrally located within the overhang defining member.

In certain presently preferred embodiments of the invention, the fluid permeable wall section is annular and has a cylindrical inner peripheral surface. Furthermore, in some embodiments, the graphite or graphite-like wall defining means take the form of a circumferentially continuous ring of graphite.

The means for chilling the molten metal body may include means for impinging a stream of fluid on the body at a level below the plane of minimum convergence, and that part of the body disposed between the level of impingement and the aforesaid fluid permeable wall section, may be surrounded by a section of the wall which is impermeable to the fluid. The diameter of the inner peripheral surface of the fluid permeable wall section may be smaller than the diameter of the inner peripheral surface of the fluid impermeable section of the wall.

BRIEF DESCRIPTION OF THE DRAWINGS

These features will be better understood by reference to the accompanying drawings which illustrate several embodiments of the invention when it is employed in a multiple-site, direct chill billet casting apparatus of the type described in our co-pending Application Ser. No. 258,520 filed Apr. 29, 1981 and entitled MOLDING DEVICE AND METHOD OF FORMING THE SAME.

In the drawings.

FIG. 10 is a fifth version of the same;

FIG. 11 is a part-perspective view of the fifth version;

FIG. 12 is an exploded top perspective view of the support or stool used at the site;

FIG. 13 is a bottom perspective view of the stool cap which is removably latched to the base of the stool;

DESCRIPTION OF THE PREFERRED EMBODIMENTS

Figure 1:
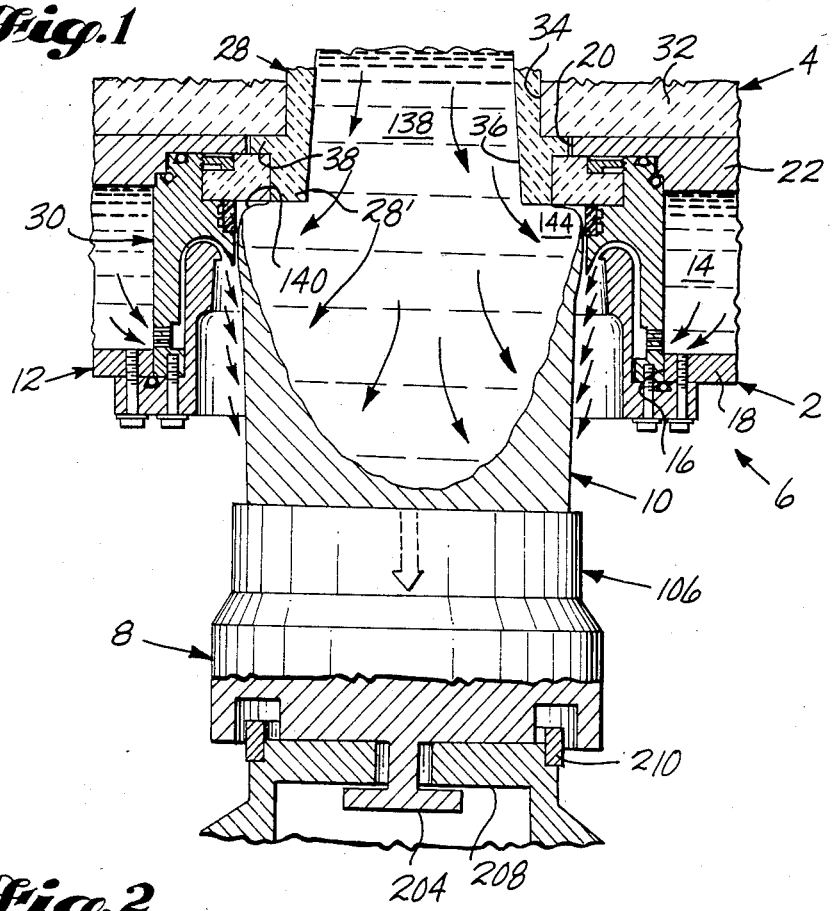
FIG. 1 is a part vertical cross-sectional view of one casting site when the casting operation is conducted with an oil and gas-impregnable ring of graphite or the like at the top of the mold cavity therein.
Figure 2:
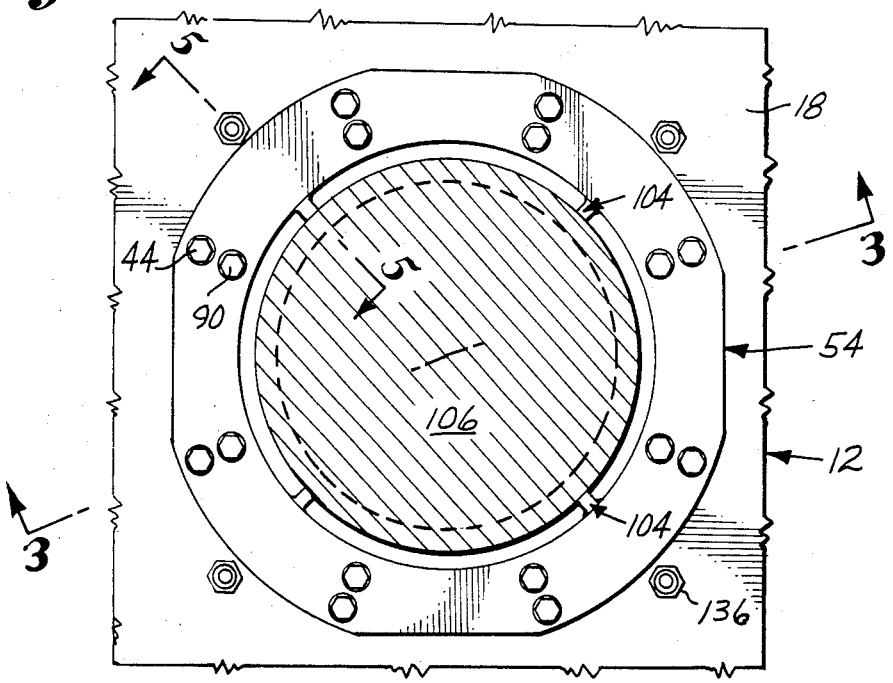
FIG. 2 is a part cross-sectional upward plan view of the site along the line 2—2 of FIG. 3.

Referring to the drawings, it will be seen that as in the co-pending Application, the billet casting apparatus comprises a multiple site casting device 2 of the coolant box type, a hot top 4 for feeding the respective casting sites 6 of the device, and an assembly of telescoping stools 8 for supporting the elongated billets 10 progressively formed at the sites. The casting device comprises a large widely dimensioned box 12 having a correspondingly sized chamber 14 therein for circulating a liquid coolant such as water to the respective casting sites. The box 12 also has equally sized openings 16 in the bottom 18 thereof, corresponding in number and location to the castings sites, and equally sized openings 20 in the top 22 thereof which are vertically aligned with but smaller than the bottom openings 16 of the box at the respective sites. The top openings 20 each have an annular rabbet 40 (FIG. 3) about the inner peripheral edge thereof, the vertical wall of which is rabbeted in turn at the bottom thereof to form an annular shoulder or step 42 thereon. The bottom openings 16 each have a set of threaded holes 24 (FIG. 4) spaced about the perimeter thereof for an attachment purpose to be explained, and an additional set of threaded holes 26 (FIG. 5) more radially offset therefrom, which are employed in plumbing air and lubricating oil to the site, as shall also be explained.

The hot top 4 includes a molten metal distribution pan 32 which has a set of apertures 34 therein that are adapted to hold an equal number of insulative refractory scuppers 28 at the respective casting sites. The apertures register with but are smaller in diameter than the corresponding top openings 20 of the box, and are sized to slideably receive the scuppers. Each scupper has a tapered bore 36 and a cylindrical outer configuration which is flanged at an intermediate level thereof. The flanges 38 are sized to fit within the openings 20 of the box. When the pan 32 is in place, the scuppers are mounted in the same by inserting them upwardly through the respective bottom openings 16 of the box and then into the corresponding top openings 20 thereof. As they pass through the openings 20, they engage in the apertures 34 of the pan. Meanwhile, the flanges 38 on the outside of the scuppers telescope into the openings, leaving only the bottom portions 28′ of the scuppers depending within the chamber.

In addition to the box, the casting device also comprises a set of annular billet casting molds 30 which are likewise mounted at the respective sites by inserting them upwardly through the bottom openings 16 of the box. However, in this case, the molds are abutted against the top 22 of the box and engaged between the depending portions 28′ of the scuppers and the rabbeting 40,42 about the openings 20 of the box. When so engaged, they seal with the top of the box, as shall be explained, and trap the flanges 38 of the scuppers in the openings 20 of the box. They also engage with the bottom of the box, and seal to it as well, as shall be explained. Ultimately, capscrews 44 are employed to secure the molds in place, using the threaded holes 24 about the respective openings 16.

Each billet casting mold 30 (FIG. 4) comprises a deep cylindrically inner surfaced metal casting ring 46, a more shallow, but similarly inner surfaced graphite feed ring 48 of slightly smaller inner diameter, a relatively flat, small diameter, cylindrically inner surfaced top ring 50 of insulative refractory material, a retainer ring 52 for use between the rings 46 and 50, and a widely flanged attachment ring 54 that cooperatively inserts within the casting ring 46 to define a coolant flow passage 56 therebetween (FIG. 3), as shall be explained. The casting ring has a wide, deeply inset, inner peripheral rabbet 58 at the top thereof, and the bottom of the same has a narrow and more shallow rabbet 60 at the inner peripheral edge thereof. The vertical wall of the wider rabbet 58 is threaded at the top thereof, and after the feed ring 48 and the top ring 50 are seated in the respective rabbets 60, 58 in that order, the retainer ring 52 is threaded into an outer peripheral rabbet 62 in the upper surface of the top ring 50, to clamp the assembly in place. Additionally, there is a narrower outer peripheral rabbet 64 at the top of the casting ring, an annular groove 66 acutely angled into the corner of the rabbet, and an annular dovetail-cross-sectioned groove 68 in the top of the ring just inside of the rabbet 64. A pair of elastomeric O-rings 69 and 70 is seated in the respective grooves, to form a seal between the top of the casting ring and the abutting surface of the rabbet 40 in the top of the box, on one hand, and the corner of the rabbet 64 of the ring 46 and the shoulder or step 42 of the box on the other. Meanwhile, the smaller diameter top ring 50 is slideably engaged about the scupper and together with the bottom of the scupper, forms a wide overhang 71 directly above the feed ring. The top ring and retainer ring normally do not abut the top of the box, however.

At the bottom, the casting ring 46 has a high inner peripheral rabbet 72, the vertical wall 74 of which is somewhat radially enlarged at levels above that corresponding to the bottom of the chamber 14 when the mold is inserted therein. Moreover, the top of the step 74 of the rabbet is circumposed about the ring at a level adapted for discharging a curtain of coolant liquid onto the emerging billet from the chamber. The top also has an acruate recess 76 therein which terminates just short of the inner periphery of the ring. At the bottom, the step has a shallow circumferential recess 78 thereabout which has a series of holes 80 in outer peripheral wall thereof that open into the outer peripheral face of the ring.

Figure 3:
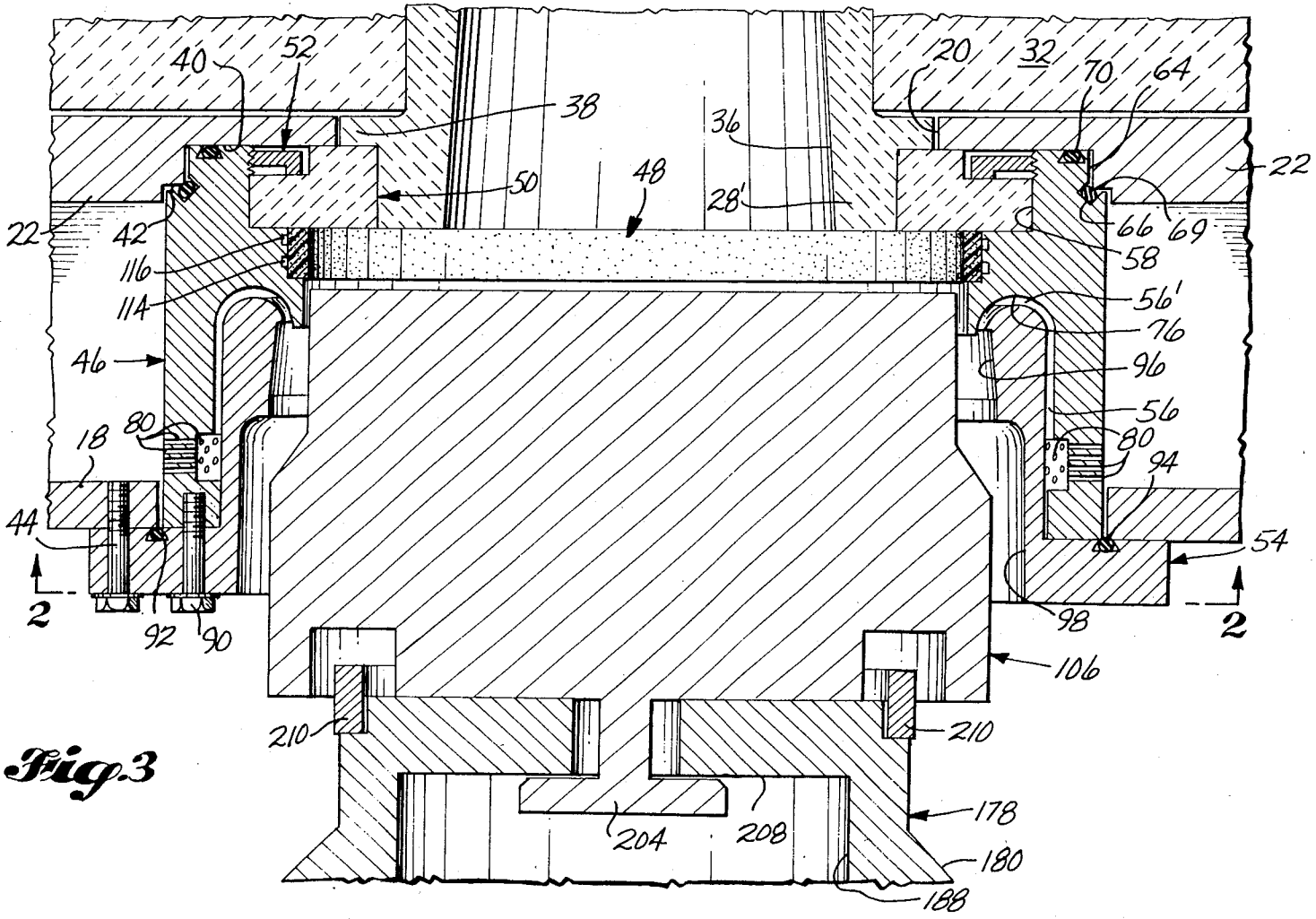
FIG. 3 is a part cross-sectional view of the site along the line 3—3 of FIG. 2.
Figure 4:
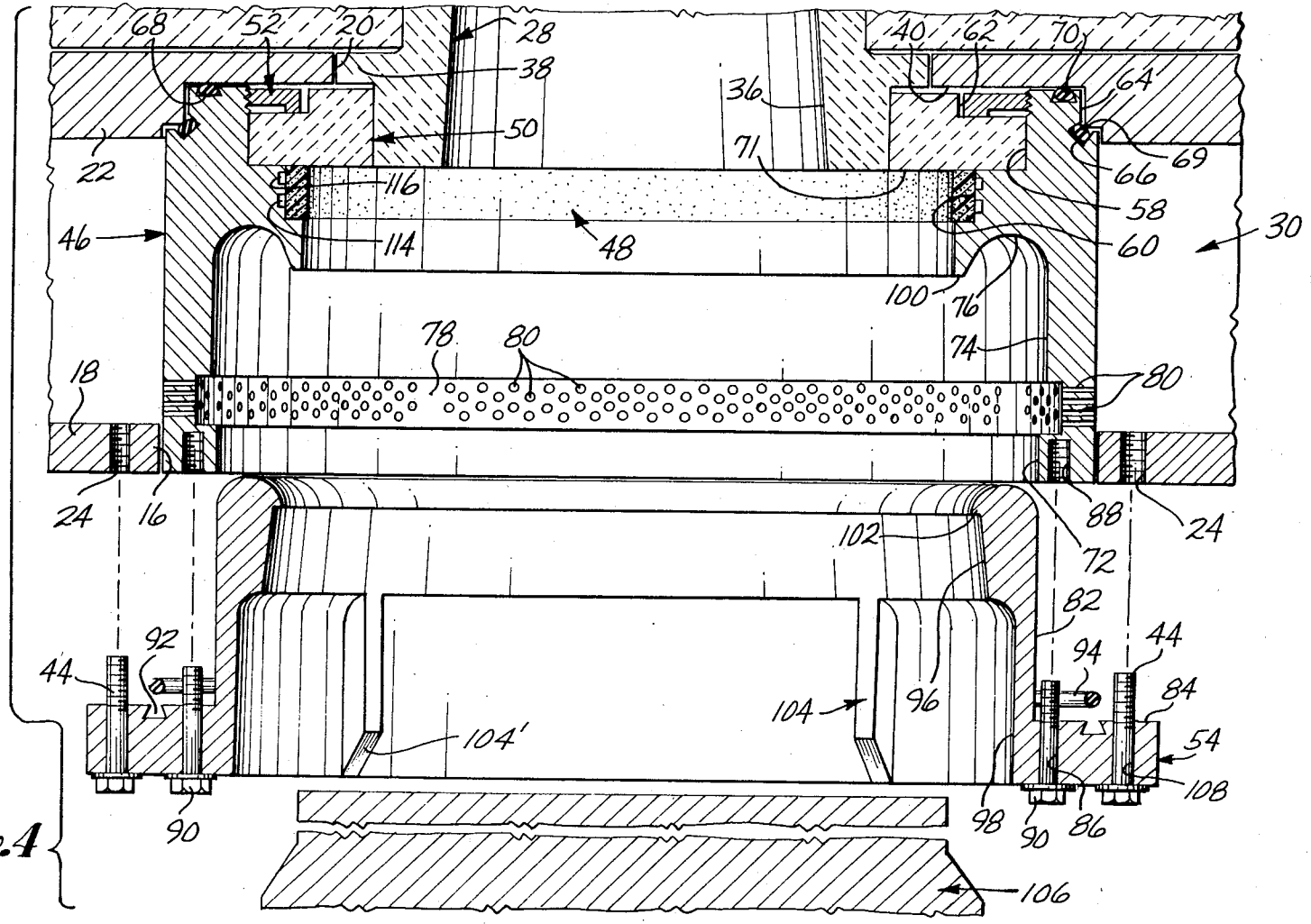
FIG. 4 is a partially exploded, part cross-sectional view of the site.

The attachment ring 54 has a greater diameter than the opening 16 of the box, but has a deeply inset outer peripheral rabbet 82 about the top thereof so that the top can telescope within the step 74 of the casting ring when the remaining flange 84 of the attachment ring abuts against the bottom of the box. Registering holes 86 and 88 in the flange and the bottom of the casting ring, respectively, enable capscrews 90 to be used in securing the rings together when they are mated and abutted inboard of the flange, as shown in FIG. 3. In addition, there is an annular dovetailed groove 92 in the flange of the attachment ring at the radius of the joint between the casting ring and the opening 16 of the box to accommodate an O-ring 94 for sealing the joint.

The attachment ring 54 also has additional holes 108 in the flange 84 thereof which are symmetrically spaced about the outboard portion of the flange to register with the threaded holes 24 in the bottom of the box. When the mold 30 is telescoped in the box, the capscrews 44 are inserted through the holes 108 and threaded into the holes 24 to secure the member to the box.

At its top, the attachment ring 54 is rounded to a semitoroidal configuration corresponding to that of the recess 76 of the step in the ring 46, but smaller in radius than the recess so that an arched continuation 56′ of the annular passage 56 is formed between the two rings at the respective rabbets 82, 72 thereof. The attachment ring is also relieved at the inner peripheral thereof to have a slightly conical recess 96 about the upper end portion thereof which descends to a greater diameter recess 98 about the bottom portion thereof. The recess 96 is sized to a greater inside diameter than the rounded top of the ring, so that when coolant escapes through the reentrant passage 56, 56', it discharges freely onto the billet between the remaining lip 100 and toe 102 of the respective rings 46, 54. The recess 98 has a plurality of symmetrically angularly spaced, bottom chamferred ribs 104 thereabout to serve as guides for the cap 106 of the associated stool 8, as shall be explained.

There are also four symmetrically angularly offset pairs of cooperating fluid flow passages 110 and 112 (FIG. 5) in the rings 54 and 46, respectively, which are individually interconnected with one another from one ring to the other to supply air and lubricating oil, respectively, to a pair of circumferential grooves 114 and 116 in the vertical wall of the rabbet 60 of the ring. The respective pairs of passages are supplied by a corresponding number of radially outwardly directed holes 118 in the mouth of the opening 16 of the box, which are supplied in turn through the threaded holes 26 in the bottom of the box. Each passage 110 in the ring 54 includes a radially inwardly directed hole 120 in the outer peripheral edge of the flange 84 thereof, which interconnects at its inside end with a vertical hole 122 in the abutting face of the flange. Each passage 112 in the ring 46 includes a vertically upwardly directed hole 124 in the bottom of the ring, which interconnects with an obliquely inwardly directed hole 126 or 126' in the outer peripheral face of the same. Every other obliquely directed hole 126 terminates in the groove 114, whereas the remaining holes 126' terminate in the groove 116. Otherwise, the respective pairs of passages 110, 112 are similar in that the holes 118 and 120 in the box and flange of the ring 54, are interconnected by registering vertical holes 128 and 130 in the bottom of the box and the abutting face of the flange, respectively; and the holes 122 and 124 in the flange and ring 46 register with one another across the face of the flange. In addition, the holes 118, 120, 126 and 126' are plugged at their mouth ends. As a result, when the mold 30 is telescoped in the box, fluid fed to the respective holes 26 in the box makes its way through the respective pairs of passages 110, 112 to either the groove 114 or the groove 116, depending on which is the terminus of the passage 112 in the ring 46.

A feed hose 134 coupled to a threaded nipple 136 at each of the holes 26 supplies the respective fluid. Additionally, the holes 130 and 122 are counterbored at the face of the flange 84 to accommodate a pair of O-rings 132 which are seated in the same to seal the joints between the pairs of holes 128, 130 and 122, 124.

Figure 5:
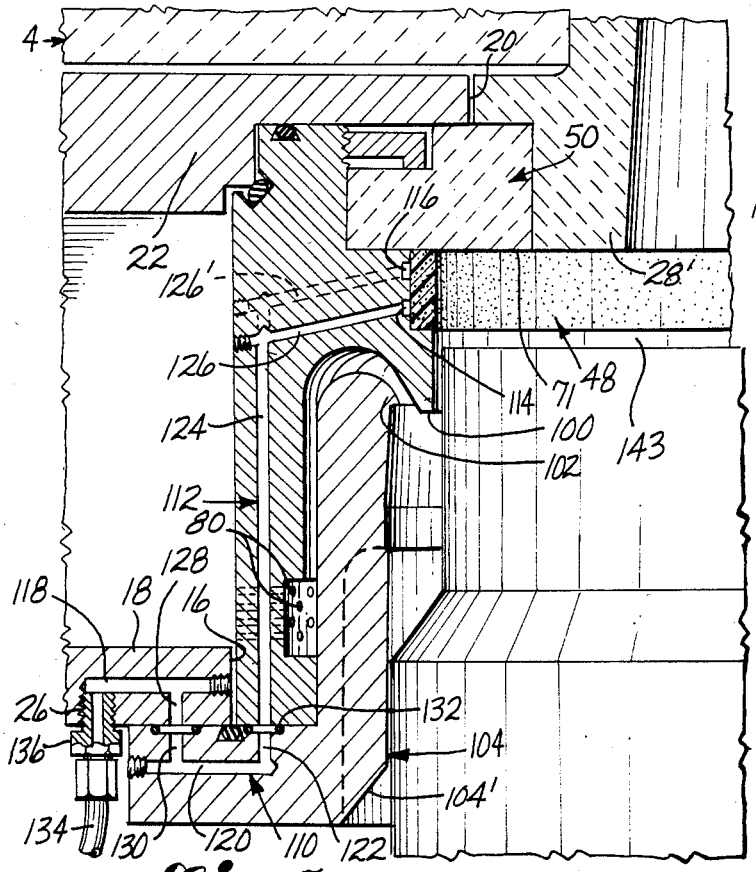
FIG. 5 is an enlarged part cross-sectional view of the site along the line 5—5 of FIG. 2.
Figure 6:
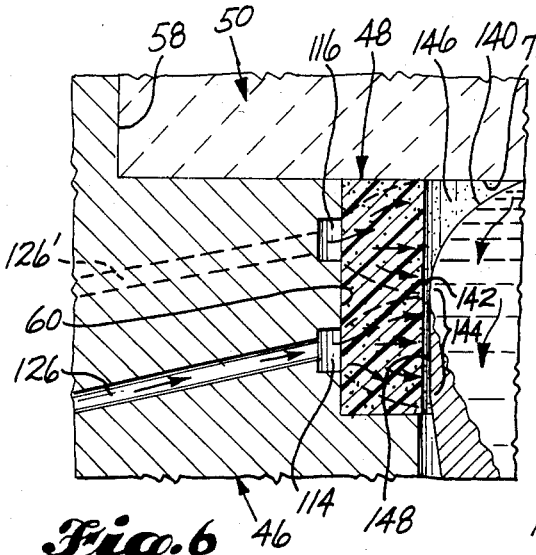
FIG. 6 is a more greatly enlarged part cross-sectional view of the site of the oil and gas-impregnable ring thereof.

Referring now to FIGS. 1, 5 and 6 in particular, it will be seen that as the molten metal 138 emerges from the scupper 28, it splays into a metallic mass the meniscus 140 of which tends to contact the peripheral wall 142 of the cavity 143 of the mold 30 in the plane of maximum divergence of the metal. Moreover, the metallic mass has a divergent-convergent cross-sectional outline between the top and bottom of the cavity, the intermediate continuum 144 of which between the planes of maximum divergence and minimum convergence has a peripheral outline corresponding generally to the peripheral outline of the cavity at the peripheral wall 142 thereof. Meanwhile, there is a pocket 146 of relatively metal-free space formed between the meniscus 140 of the metal and the top corner 71, 142 of the cavity at the overhang 71 of the opening 20. In the prior art, pressurized air was pumped into the pocket 146 through an annular slit (not shown) about the overhang 71, and an oil was forced through channels (not shown) opening into the slit, or into the pocket at a level slightly below the slit, to lubricate the wall 142 of the cavity. According to the invention, however, a lubricating oil is pumped into the upper groove 116 and a stream of pressurized gas such as air is pumped into the groove 114, so that the oil and gas diffuse simultaneously through the body of the graphite ring 48 and discharge into the cavity at the inner peripheral surface 142 of the ring 48 while the molten metal mass is chilled and the stool 8 is reciprocated in relation to the mold 30 axially of the cavity to form the chilled mass into an elongated billet of the metal.

The grooves 114 and 116 are commonly vertically symmetrically spaced from one another and from the bottoms of the rabbets 58 and 60 of the ring 46. Also, the respective fluids, oil and air, are commonly pumped to the grooves at about 20–30 psi. The graphite is commonly a molded, very fine grain, essentially flaw-free, high strength graphite such as the ATJ graphite sold by the Carbon Products Division of Union Carbide Corporation, Chicago, IL. Preferably, it also machines to a fine surface finish and has a high thermal conductivity.

Figure 7:
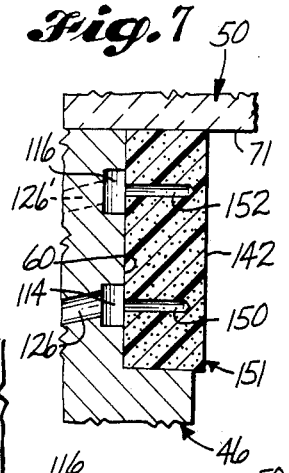
FIG. 7 is a similar view of an alternative form of ring.

In FIGS. 1–6, the air and oil are delivered to points 114, 116 at the outer peripheral surface of the graphite facing medium 48. In FIG. 7, the graphite medium 151 has delivery holes 150 and 152 in the outer peripheral surface thereof, which open into the respective grooves 114 and 116 and extend radially inwardly therefrom, but terminate short of the inner peripheral surface 142 of the ring. In this way, the respective fluids are delivered to points within the body of the graphite medium where they can diffuse through the surface of the medium over an arc of shorter radius.

Figure 9:
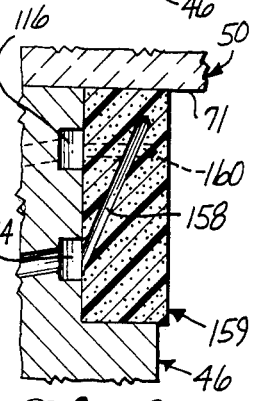
FIG. 9 is a fourth version of the ring.
Figure 8:
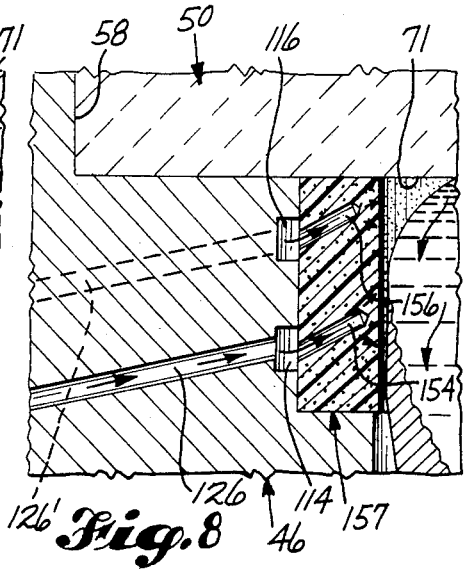
FIG. 8 is another such view of still another form of ring.
Figure 14:
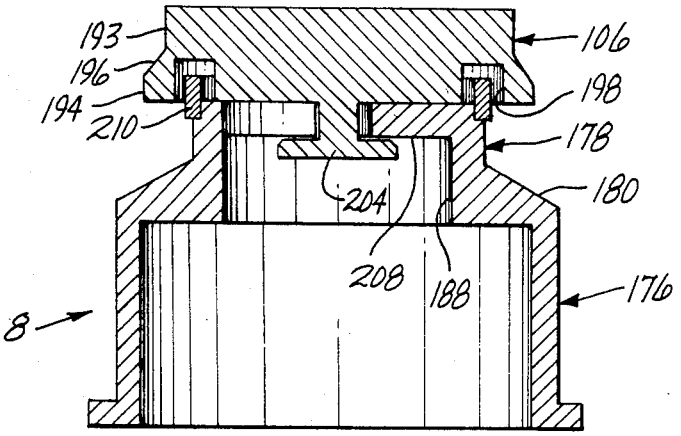
FIG. 14 is a vertical cross-sectional view of the stool in the latched condition of the cap.

If desired, the respective sets of delivery holes may be angled away from the horizontal, such as are holes 154 and 156 in FIG. 8, which are angled upwardly from the grooves 114, 116, but again terminate short of the inner peripheral face 142 of the ring 157. Furthermore, depending on the situs of the intermediate continuum 144 of the metal, the oil and air need not be delivered to grooves above and below one another, respectively. In FIG. 9, the oil is delivered to the bottom groove 114, and sharply upwardly inclined holes 158 in the outer peripheral surface of the graphite medium 159 are employed to deliver the oil to a level which is disposed above the holes 160 for the air and corresponds to the level of the pocket in the cavity of the mold. Meanwhile, the air is delivered to the upper groove 116, which in turn delivers the air to the forward ends of the holes 160 for the same.

In FIGS. 10 and 11, the air is delivered to an annular groove 162 in the outer peripheral surface of the graphite ring 164 itself, and the oil is delivered to a higher groove 166 having a scabbard-like extension 166 of the same extending somewhat downwardly therefrom radially inwardly of the ring. In addition, the bottom of the top ring 50' has an annular rabbet 170 about the outer peripheral edge thereof, and the graphite ring is elevated into the corner of this rabbet, and rabbeted itself to have an annular inner peripheral step 172 about the bottom thereof, the top of which is generally co-planar with the bottom 71 of the top ring. However, the top of the step has a swale-like recess 174 therein which lies slightly ahead of the forward end of the extension 168 of the groove 166. Thus, in this embodiment, oil is bled into the top of the pocket 146 at the overhang itself, as well as into the inner peripheral surface 142 of the ring in the manner of the earlier embodiments. Providing a recessed feed surface 174 for the oil also aids in trapping more oil vapor at the top of the pocket to decrease the cooling effect at that point.

In an alternative form of the invention, the castor oil, peanut oil or other lubricating oil delivered to either of the grooves 116 and 166, is suspended in a highly vaporizable liquid carrier such as alcohol, and the heat generated in the graphite ring during the casting operation is relied on to vaporize the carrier by the time it discharges at the inner peripheral face of the ring. The vapor of the carrier then becomes a part of the annulus 148 about the metallic mass and may substitute entirely for the gaseous medium normally supplied to the grooves 114 and 162, thus obviating any need for delivering gas to the same. Alternatively or additionally, the vapor of the carrier may be employed to modify the gaseous/vaporous character of the annulus, and/or to increase the top cooling of the metallic mass.

Referring now to FIGS. 12–16, it will be seen that each stool cap 106 rests on a pedestal-like base 176 and is engaged with the top 178 of the base so as to be capable, within limits, of shifting laterally of the base when the stool is telescoped into the corresponding mold 30 of the device. The top of the base is hollow and has a tapering skirt 180 about the bottom thereof. The top also has an annular rabbet 182 about the top surface 184 thereof, and there is a keyhole-shaped hole 186 in the surface which opens into the hollow bore 188 of the top at the periphery thereof. The hole 186 has a circular main section 190 at the periphery of the bore, and an adjoining part circular side section 192 radially inside thereof, the center of which is disposed on the vertical axis of the base.

The top 193 of the cap is cylindrical and sized to telescope within the bore of the casting ring 46. However, the bottom 194 of the cap is more enlarged to telescope only within the circle of ribs 104 on the attachment ring 54, and there is a shoulder 196 between the two portions of the cap which tapers radially outwardly and downwardly thereof at the same inclination as the bottoms 104' of the ribs. The shoulder 196 is also disposed at such a height on the cap that it will engage the bottoms 104' of the ribs before the top of the cap enters the casting ring, thus assuring that the cap is aligned with the ring before it telescopes within the same.

The cap also has a wide annular groove 198 in the bottom surface 200 thereof, which is disposed to register with the rabbet 182 on the top 178 of the base 176 when the two members are coaxial with one another. In addition, at the center of the surface 200, there is a flanged catch 202 which is sized at the flange 204 thereof to pass through the main section 190 of the hole 186 in the base. The flange is also spaced sufficiently below the bottom surface of the cap to be able to slideably engage with the underside 208 of the top 178 of the base when the surfaces 200, 184 of the cap and base are engaged and the cap is shifted laterally inwardly of the base to engage the members against relative axial displacement, as shall be explained. The shank 206 of the catch, on the other hand, is sized to fit within the side section 192 of the hole, when the cap is so shifted.

In addition to the cap 106 and the base 176, the stool 8 also comprises a ring 210 which is sized to slideably engage about the top of the base in the rabbet 182 thereof. When the ring is in this position, moreover, it is sized to stand well above the surface 184 of the base and to fit within the groove 198 of the cap when the cap is rested on the surface 184 of the base, coaxially thereof. The ring 210 is also sized to be elevated into the groove, flush with the surface 200 of the cap, as shall be explained. The groove 198, on the other hand, is greatly oversized in widthwise relation to the ring, so that when the cap is rested on the base and the ring is registered with the groove, the cap can shift laterally of the ring for purposes of aligning itself with the casting ring of the device as mentioned. There is a point, however, at which the cap and ring will abut one another, and this point is in advance of the point at which the catch shifts into vertical alignment with the main section 192 of the hole 186 in the top of the base.

The stool 8 is assembled by lifting the ring 210 into the groove 198 of the cap, inserting the catch 202 in the hole 186 of the base, and then while the cap is rested on the top of the base, shifting it laterally thereof to engage the shank 206 of the catch in the side section 192 of the hole. The ring is then released to engage with the step 212 of the rabbet 182, as in FIG. 14. In this condition, the cap and base are latched against relative axial displacement, but the cap can slide laterally of the base on the surface 184 of the same, within the limits afforded by the loose engagement between the ring 210 and the groove 198.

Figure 15:
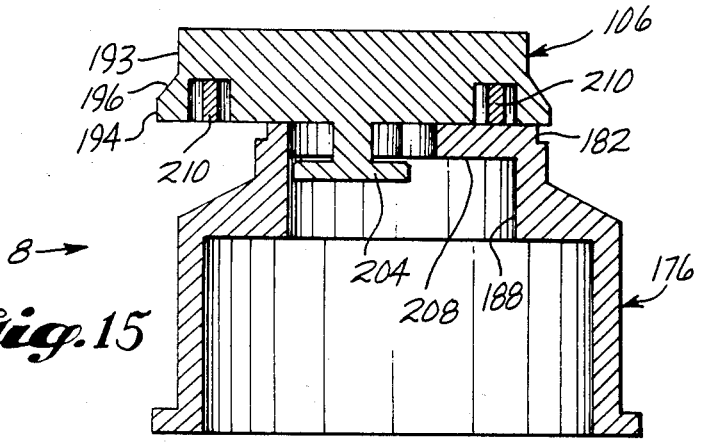
FIG. 15 is a similar view of the stool after the cap has been unlatched.
Figure 16:
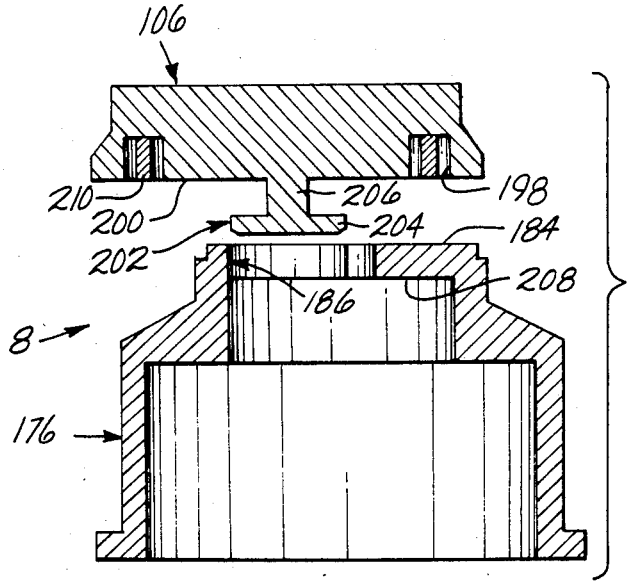
FIG. 16 is a third such view of the stool after the cap has been removed.

When it is desired to remove and replace the cap, for example, with a cap of a different size, the ring 210 is raised into the groove 198 and the cap is slid into alignment with the main section 190 of the hole 186 so that it can be lifted away from the base, as in FIGS. 15 and 16.

It will be apparent that the invention is applicable to the casting of all cross-sectional outlines including round, square and rectangular; and that it is applicable to both vertical and horizontal casting, including continuous casting. Also, only a single nipple 136 and passage 110, 112 is needed for each fluid; and many other changes and additions can be made in and to the invention without departing from the scope and spirit of the same as defined by the following claims.

What is claimed is:

1. In the process of direct chill casting a metal in an open ended mold cavity having a support telescoped in the discharge end thereof and an opening at the other end thereof whose diameter is smaller than the peripheral wall of the cavity so that the inner peripheral edge of said other end opening forms an overhang relatively over the wall, the steps of:

continuously filling said other end opening of the cavity with molten metal so that the mass of molten metal splays about the inner peripheral edge of the other end opening and forms a body of molten metal in the cavity whose cross-section has a divergent/convergent outline between the ends thereof, the intermediate continuum of which between the planes of maximum divergence and minimum convergence thereof, has a peripheral outline corresponding generally to the outline of the cavity at the peripheral wall thereof, circumposing graphite or graphite-like wall defining means about the molten metal body in the peripheral wall of the cavity at a level below the overhang adapted so that the intermediate continuum is surrounded by a solid but fluid permeable wall section of said means, simultaneously forcing a lubricating oil and an additional fluid medium selected from the group consisting of a highly heat vaporizable liquid medium and a gaseous medium, through the fluid permeable wall section so that the oil and additional fluid medium discharge into the cavity at points on the inner peripheral surface of the wall section opposite the intermediate continuum, and simultaneously chilling the molten metal body from points below the intermediate continuum and reciprocating the mold and support in relation to one another endwise of the cavity to elongate the body, the wall of the cavity co-terminating with the overhang at the aforesaid other end of the cavity so that the part of the molten metal body directly adjacent the overhang is surrounded by a closed corner of the cavity, and the fluid thus discharged about the intermediate continuum forming an annulus of fluid tending to flow relatively away from the closed corner of the cavity toward the discharge end thereof.

2. The process according to claim 1 wherein a stream of fluid is impinged on the molten metal body at a level below the plane of minimum convergence, to chill the body, and that part of the body disposed between the level of impingement and the aforesaid fluid permeable wall section, is surrounded by a section of the wall which is impermeable to said fluid.

3. The process according to claim 1 wherein the oil and additional fluid medium are forced into the fluid permeable wall section through the outer peripheral portion thereof.

4. The process according to claim 3 wherein the additional fluid medium is a gas, and the oil and gas are forced into the fluid permeable wall section at levels spaced apart from one another endwise of the cavity.

5. The process according to claim 4 wherein the oil and gas are forced into the fluid permeable wall section through a pair of spaced circumferential grooves extending about the wall section at the outer periphery surface.

6. The process according to claim 5 wherein the grooves have sets of holes extending peripherally inwardly therefrom, but terminating in the wall section short of the inner peripheral surface thereof.

7. The process according to claim 1 wherein the graphite or graphite-like wall defining means are circumposed about the molten metal body at a level adapted so that the part of the body directly adjacent the overhang is also surrounded by the fluid permeable wall section, and the oil and gas are forced into the wall section at levels adjacent the overhang and the plane of minimum convergence, respectively.

8. The process according to claim 1 wherein the fluid permeable wall section extends beyond the overhang in the endwise direction of the cavity, and has a step therein which is directed peripherally inwardly of the wall to define a portion of the overhang, and wherein the oil is forced into the wall section at a level adjacent the step.

9. The process according to claim 1 wherein the corner is curved opposite the meniscus to control the size of the discharge pocketed therebetween.

10. The method according to claim 1 wherein the mold cavity is disposed so that the end openings thereof are centered on a vertical line.

11. Apparatus for direct chill casting a metal comprising:

means defining an open ended mold cavity having a discharge end adapted to have a support telescoped therein, and having an opening at the opposing end thereof whose diameter is smaller than the peripheral wall of the cavity so that the inner peripheral edge of said opposing end opening forms an overhang relatively over the peripheral wall, whereby when said opposing end opening of the cavity is continuously filled with molten metal, the mass of molten metal splays about the inner peripheral edge of the opposing end opening and forms a body of molten metal in the cavity whose cross-section has a divergent/convergent outline between the ends thereof, the intermediate continuum of which between the planes of maximum divergence and minimum convergence thereof, has a peripheral outline corresponding generally to the outline of the cavity at the peripheral wall thereof, means for chilling the molten metal body from points below the intermediate continuum, graphite or graphite-like wall defining means disposed in the peripheral wall of the cavity at a level below the overhang for surrounding the intermediate continuum of the molten metal body by a solid but fluid permeable wall section, and fluid delivery means for simultaneously forcing a lubricating oil and an additional fluid medium selected from the group consisting of a highly heat vaporizable liquid medium and a gaseous medium, through the fluid permeable wall section so that the oil and additional fluid medium discharge into the cavity at points on the inner peripheral surface of the wall section opposite the intermediate continuum, while the molten metal body is chilled and the mold and support are reciprocated in relation to one another endwise of the cavity to elongate the body, the wall of the cavity co-terminating with the overhang at the aforesaid opposing end of the cavity so that the part of the molten metal body directly adjacent the overhang is surrounded by a closed corner of the cavity, and the fluid thus discharged about the intermediate continuum forming an annulus of fluid tending to flow relatively away from the closed corner of the cavity toward the discharge end thereof.

12. The apparatus according to claim 11 wherein the fluid delivery means are operable to force the oil and additional fluid medium into the fluid permeable wall section through the outer peripheral portion thereof.

13. The apparatus according to claim 12 wherein the fluid delivery means are operable to force oil and gas into the fluid permeable wall section at levels spaced apart from one another endwise of the cavity.

14. The apparatus according to claim 13 wherein there is a pair of spaced circumferential grooves extending about the wall section at the outer periphery thereof, and the fluid delivery means are operable to force the oil and gas into the wall section through the grooves.

15. The apparatus according to claim 14 wherein the grooves have sets of holes extending peripherally inwardly therefrom, but terminating in the wall section short of the inner peripheral surface thereof.

16. The apparatus according to claim 11 wherein the graphite or graphite-like wall defining means are disposed in the wall of the cavity at a level adapted so that the part of the body directly adjacent the overhang is also surrounded by the fluid permeable wall section, and the fluid delivery means are operable to force the oil and gas into the wall section at levels adjacent the overhang and the plane of minimum convergence, respectively.

17. The apparatus according to claim 11 wherein the fluid permeable wall section extends beyond the overhang in the endwise direction of the cavity, and has a step therein which is directed peripherally inwardly of the wall to define a portion of the overhang, and the fluid delivery means are operable to force the oil into the wall section at a level adjacent the step.

18. The apparatus according to claim 11 wherein the corner is curved opposite the meniscus to control the size of the discharge pocketed therebetween.

19. The apparatus according to claim 11 wherein the mold cavity is disposed so that the end openings thereof are centered on a vertical line.

20. The apparatus according to claim 11 wherein the overhang is defined by an insulative refractory member, and the member and wall section are disposed so that they abut one another at the overhang.

21. The apparatus according to claim 20 wherein the aforesaid opposing end opening of the cavity is defined by an insulative refractory scupper for a hot top, and the scupper is centrally located within the overhang defining member.

22. The apparatus according to claim 11 wherein the fluid permeable wall section is annular and has a cylindrical inner peripheral surface.

23. The apparatus according to claim 11 wherein the graphite or graphite-like wall defining means take the form of a circumferentially continuous ring of graphite.

24. The apparatus according to claim 11 wherein the means for chilling the molten metal body include means for impinging a stream of fluid on the body at a level below the plane of minimum convergence, and wherein that part of the body disposed between the level of impingement and the aforesaid fluid permeable wall section, is surrounded by a section of the wall which is impermeable to said fluid.

25. The apparatus according to claim 24 wherein the diameter of the inner peripheral surface of the fluid permeable wall section is smaller than the diameter of the inner peripheral surface of the fluid impermeable section of the wall.

* * * * *

UNITED STATES PATENT AND TRADEMARK OFFICE

CERTIFICATE OF CORRECTION

PATENT NO. : 4,598,763

DATED : July 8, 1986

INVENTOR(S) : Frank E. Wagstaff, William G. Wagstaff and Richard J. Collins

It is certified that error appears in the above-identified patent and that said Letters Patent are hereby corrected as shown below:

Column 6, line 32, "acruate" should read "arcuate".

Column 6, line 65, "peripheral" should read "periphery".

Claim 5, Column 11, line 38, "surface" should be "thereof".

Signed and Sealed this

Twenty-first Day of October, 1986

[SEAL]

*Attest:*

DONALD J. QUIGG

*Attesting Officer* *Commissioner of Patents and Trademarks*